US008628172B2

(12) United States Patent
Kinokuni et al.

(10) Patent No.: US 8,628,172 B2
(45) Date of Patent: Jan. 14, 2014

(54) LIQUID EJECTING HEAD AND IMAGE FORMING APPARATUS

(71) Applicants: Takashi Kinokuni, Tokyo (JP); Masataka Yoshiike, Kanagawa (JP); Keisuke Hayashi, Kanagawa (JP)

(72) Inventors: Takashi Kinokuni, Tokyo (JP); Masataka Yoshiike, Kanagawa (JP); Keisuke Hayashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/739,282

(22) Filed: Jan. 11, 2013

(65) Prior Publication Data

US 2013/0182040 A1 Jul. 18, 2013

(30) Foreign Application Priority Data

Jan. 16, 2012 (JP) ..... 2012-006163

(51) Int. Cl.
*B41J 2/25* (2006.01)

(52) U.S. Cl.
USPC ..... 347/47; 347/43

(58) Field of Classification Search
USPC ..... 347/40, 43, 47, 64, 65
See application file for complete search history.

(56) References Cited

U.S. PATENT DOCUMENTS 6,682,185 B2 1/2004 Hashimoto et al.
7,651,205 B2 1/2010 Hayashi
7,810,895 B2 * 10/2010 Yamada ..... 347/15
7,871,153 B2 1/2011 Hayashi
8,042,918 B2 10/2011 Hayashi
8,282,193 B2 * 10/2012 Brookfield et al. ..... 347/40
2010/0171798 A1 7/2010 Yamaguchi et al.
2010/0328409 A1 12/2010 Matsufuji et al.
2011/0298872 A1 12/2011 Hayashi
2012/0182356 A1 7/2012 Hayashi et al.

FOREIGN PATENT DOCUMENTS

JP 2002-292868 10/2002
JP 2010-158806 7/2010
JP 2011-25683 2/2011
JP 2011-56729 3/2011

* cited by examiner

*Primary Examiner* — Lamson Nguyen
(74) *Attorney, Agent, or Firm* — Cooper & Dunham LLP

(57) ABSTRACT

Disclosed is a liquid ejecting head, including two nozzle sequences, each nozzle sequence including nozzles for ejecting a liquid drop, separate liquid chambers communicating with the nozzles, and two common liquid chambers for supplying a liquid to the separate liquid chambers and correspond to the two nozzle sequences, each common liquid chamber including a supply port for supplying a liquid thereto, an aperture, a cross-section thereof in a second direction orthogonal to a first direction of arrangement of the plural nozzles decreasing toward an end portion thereof in the first direction, wherein the supply port and aperture of one of the two common liquid chambers are provided at one end portion and the other end portion in the first direction, respectively, and the supply port and aperture of another one are provided at the other end portion and the one end portion in the first direction, respectively.

6 Claims, 13 Drawing Sheets

LIQUID EJECTING HEAD AND IMAGE FORMING APPARATUS

BACKGROUND OF THE INVENTION

1. Field of the Invention

An aspect of the present invention relates to at least one of a liquid ejecting head and an image forming apparatus.

2. Description of the Related Art

For an image forming apparatus such as a printer, a facsimile machine, a plotter, or a complex machine thereof, there is known, for example, a liquid ejection recording type image forming apparatus using a recording head composed of a liquid ejecting head (liquid drop ejection head) for ejecting a liquid drop of ink, for example, an ink-jet recording apparatus.

A liquid ejecting head has, for example, plural nozzles for ejecting a liquid drop, a separate liquid chamber communicated with each nozzle (also referred to as a "separate flow channel"), and a common liquid chamber for supplying a liquid to each separate liquid chamber (also referred to as a "common flow channel"), wherein a liquid in such a separate liquid chamber is pressurized by a pressure generating part such as a piezoelectric actuator, a thermal actuator, or an electrostatic actuator, to eject a liquid drop.

For a configuration of a common liquid chamber in such a liquid ejecting head, it is known that a supply port part and a discharge port part, each of which communicates with an exterior, are provided at sides of both end portions of a common liquid chamber in a direction of nozzle arrangement and a liquid is circulated in the common liquid chamber, thereby reducing retention of air bubbles (Japanese Patent Application Publication No. 2011-025663).

Furthermore, it is known that a supply port part is provided at a central portion of a common liquid chamber in a direction of nozzle arrangement and an aperture part is provided whose cross-section in a direction orthogonal to a direction of nozzle arrangement gradually decreases toward both end portions in a direction of nozzle arrangement, thereby improving a flow rate at both end portions and reducing retention of air bubbles (Japanese Patent Application Publication No. 2011-056729).

Furthermore, it is also known that positions for providing supply port parts and/or aperture parts are different among plural common liquid chambers (Japanese Patent Application publication No. 2010-158806).

Meanwhile, when a configuration is provided in such a manner that a supply port part is provided at a side of one end of a common liquid chamber in a direction of nozzle arrangement and an aperture part is provided at a side of the other end, a fluid resistance in the common liquid chamber from the supply port part to a separate liquid chamber may be greatly different between an upstream side and a downstream side of flow. Accordingly, a difference may be generated in an amount of a liquid supplied to the separate liquid chamber so as to cause a deviation in an amount of ejection between a side of one end of a nozzle sequence and a side of the other end and a variable density in a formed image.

In particular, an irregularity of density may be easily-noticeable in a case where an image with a high density such as a photographic image is formed wherein an amount of ejection per unit area increases, a case where an image is formed at a high speed wherein an amount of ejection per unit time increases, a case where a thin halftone image is formed although an amount of an ejected drop is not large, etc.

SUMMARY OF THE INVENTION

According to one aspect of the present invention, there is provided a liquid ejecting head, including at least two nozzle sequences, each nozzle sequence including plural nozzles configured to eject a liquid drop, plural separate liquid chambers configured to communicate with the plural nozzles, and at least two common liquid chambers configured to supply a liquid to the plural separate liquid chambers and correspond to the at least two nozzle sequences, each common liquid chamber including a supply port configured to supply a liquid thereto, an aperture, a cross-section of the aperture in a direction orthogonal to a direction of arrangement of the plural nozzles decreasing toward an end portion of each common liquid chamber in the direction of arrangement of the plural nozzles, wherein the supply port of one of the at least two common liquid chambers is provided at a side of one end portion of the at least two common liquid chambers in the direction of arrangement of the plural nozzles and the aperture of the one of the at least two common liquid chambers is provided at a side of the other end portion of the at least two common liquid chambers in the direction of arrangement of the plural nozzles, and wherein the supply port of another one of the at least two common liquid chambers is provided at a side of the other end portion of the at least two common liquid chambers in the direction of arrangement of the plural nozzle and the aperture of the another one of the at least two common liquid chambers is provided at a side of the one end portion of the at least two common liquid chambers in the direction of arrangement of the plural nozzles.

According to another aspect of the present invention, there is provided an image forming apparatus, including a conveyance part configured to convey a recording medium, and a recording head configured to eject a liquid drop onto the recording medium, wherein the recording head includes the liquid ejecting head as described above.

DETAILED DESCRIPTION OF THE PREFERRED EMBODIMENTS

Figure 1:
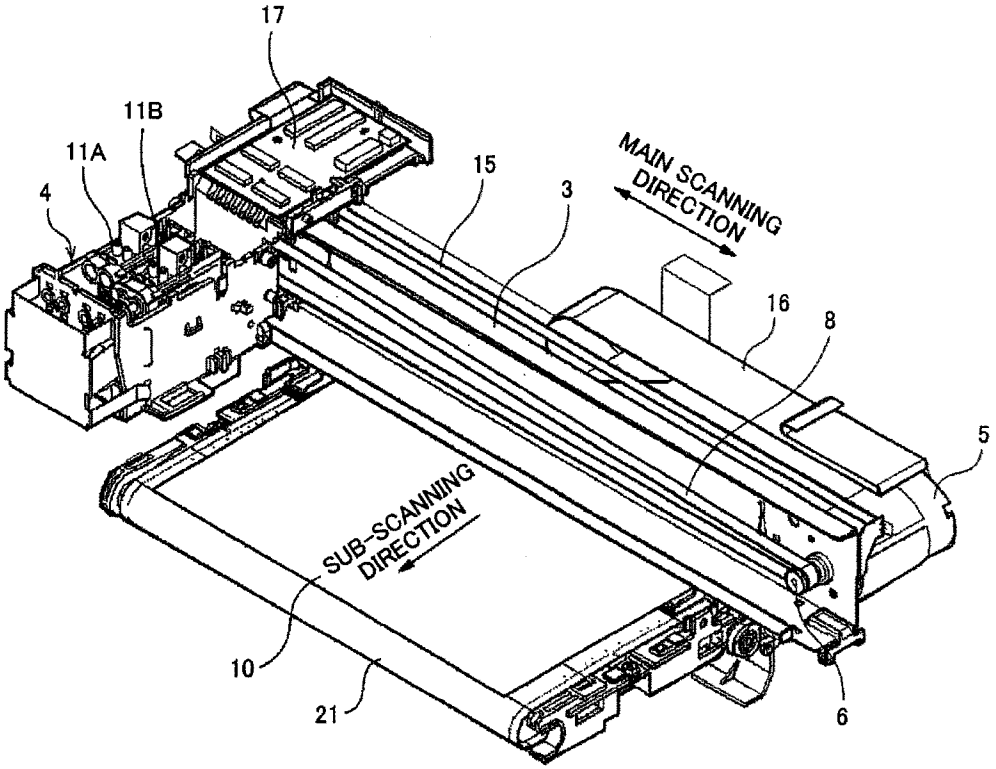
FIG. 1 is perspective illustration diagram illustrating one example of a mechanical part of an image forming apparatus according to an embodiment of the present invention.

An embodiment of the present invention will be described with reference to the accompanying drawings below. First, one example of an image forming apparatus including a liquid ejecting head according to an embodiment of the present invention will be described with reference to FIG. 1. FIG. 1 is a perspective illustration diagram of a mechanical part of the image forming apparatus.

In such an image forming apparatus, a carriage 4 is supported to be movable in a main scanning direction by a guide member 3 composed of a plate-type member which is a guiding member and the carriage 4 is moved for scanning in a main scanning direction by a main scanning motor 5 via a timing belt 8 which is provided on the peripheries of a driving pulley 6 and a driven pulley that is not illustrated in the figure on a condition of extending therebetween.

On the carriage 4, a recording head 11A or 11B (referred to as a "recording head 11" if no distinction therebeween is made, similarly below) which is composed of a liquid ejecting head unit provided by integrating a liquid ejecting head according to an embodiment of the present invention as an image forming part for ejecting a liquid drop and a head tank is mounted in such a manner that a nozzle sequence composed of plural nozzles is arranged in a sub-scanning direction orthogonal to a main scanning direction and a direction of drop ejection is directed downward.

To a head tank of the recording head 11, an ink with a required color is supplied from a liquid cartridge that is not illustrated in the figure (or a main tank, referred to as an "ink cartridge" below) at a side of an apparatus body through a supply tube.

Furthermore, an encoder scale 15 is arranged along a main scanning direction for the carriage 4 and an encoder sensor which is composed of a transmission-type photosensor for reading a scale (scale: position identifying part) of the encoder scale 15, that is not illustrated in the figure, is attached to a side of the carriage 4.

Herein, a carriage-side substrate 17 (referred to as a "relaying substrate", below) which is connected to a control substrate mounted with a control part of an apparatus body via a flexible flat cable (FFC) 16 is mounted on the carriage 4. Such a relaying substrate 17 is mounted with a circuit for conducting signal communication with the encoder sensor described above or a driving circuit (driver IC) at a side of the recording head 11. Such a relaying substrate 17 and the recording head 11 are connected via a flexible wiring member as described below.

On the other hand, a conveyance belt 21 as a conveyance part for conveying a paper sheet 10 in a sub-scanning direction is arranged at a downside of the carriage 4. Such a conveyance belt 21 is an endless belt, which is provided on the peripheries of a conveyance roller and a tension roller and moved peripherally in a sub-scanning direction by rotationally driving the conveyance roller via the timing belt and a timing pulley due to a sub-scanning motor that is not illustrated in the figure.

In such an image forming apparatus that is thus configured, a fed paper sheet is intermittently conveyed by the conveyance belt 21 and the recording head 11 is driven depending on an image signal while the carriage 4 is moved in a main scanning direction, so that an image is formed on a paper sheet by repeating an operation for ejecting a liquid drop onto a stopped paper sheet to record one line, conveying such a paper sheet by a predetermined amount, and conducting recording of a next line, and such a paper sheet after image formation is ejected.

Figure 2:
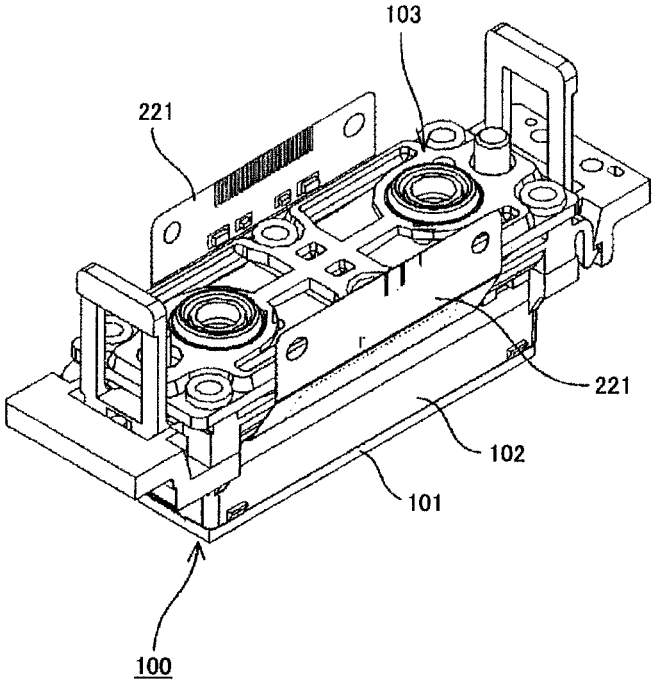
FIG. 2 is an appearance perspective illustration diagram of one example of a liquid ejecting head according to an embodiment of the present invention.
Figure 3:
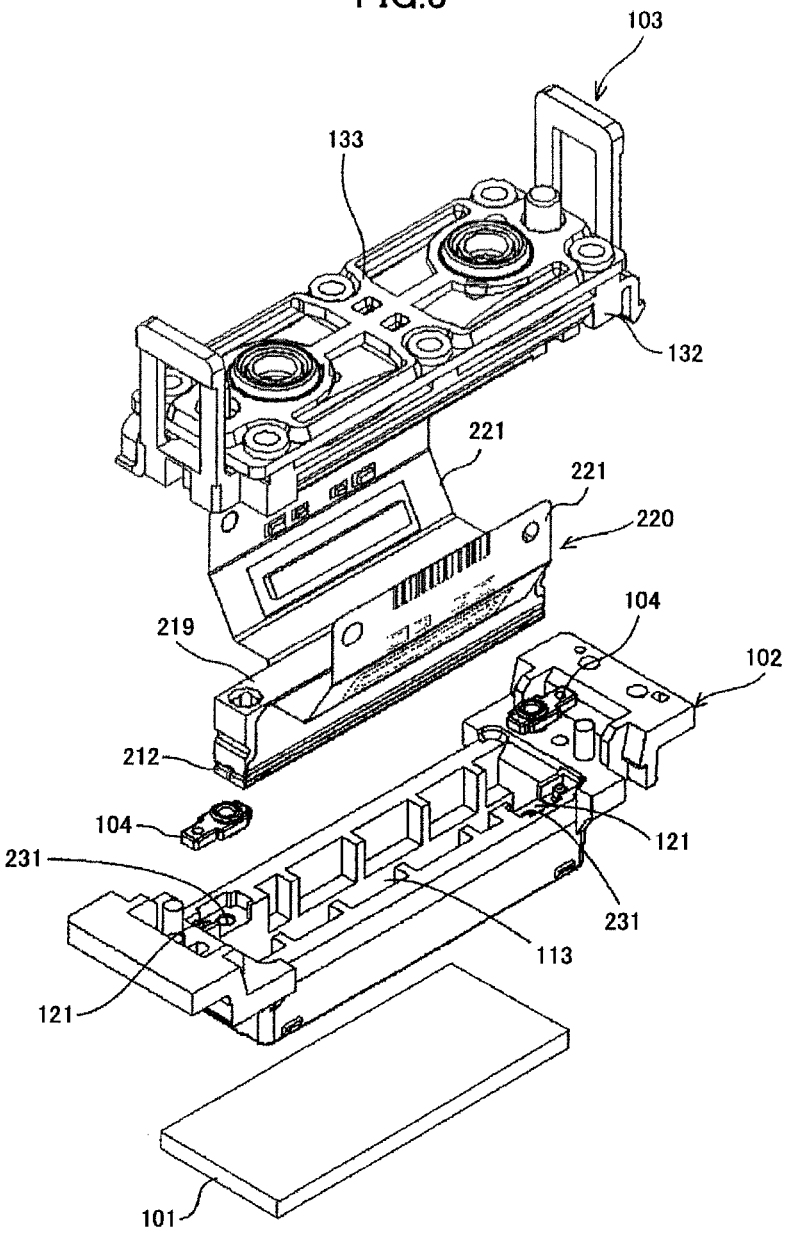
FIG. 3 is an exploded perspective illustration diagram of the liquid ejecting head.
Figure 4:
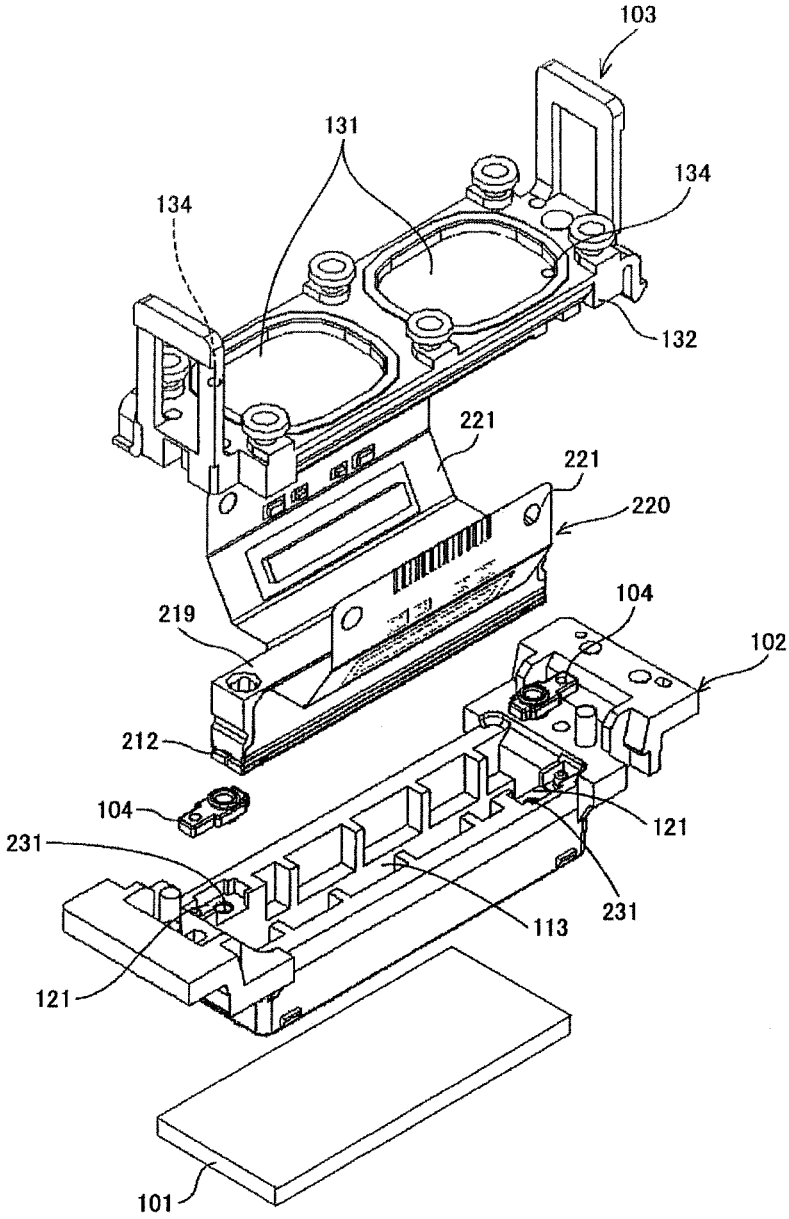
FIG. 4 is an exploded perspective illustration diagram of the liquid ejecting head on a condition that a part of components is removed.
Figure 5:
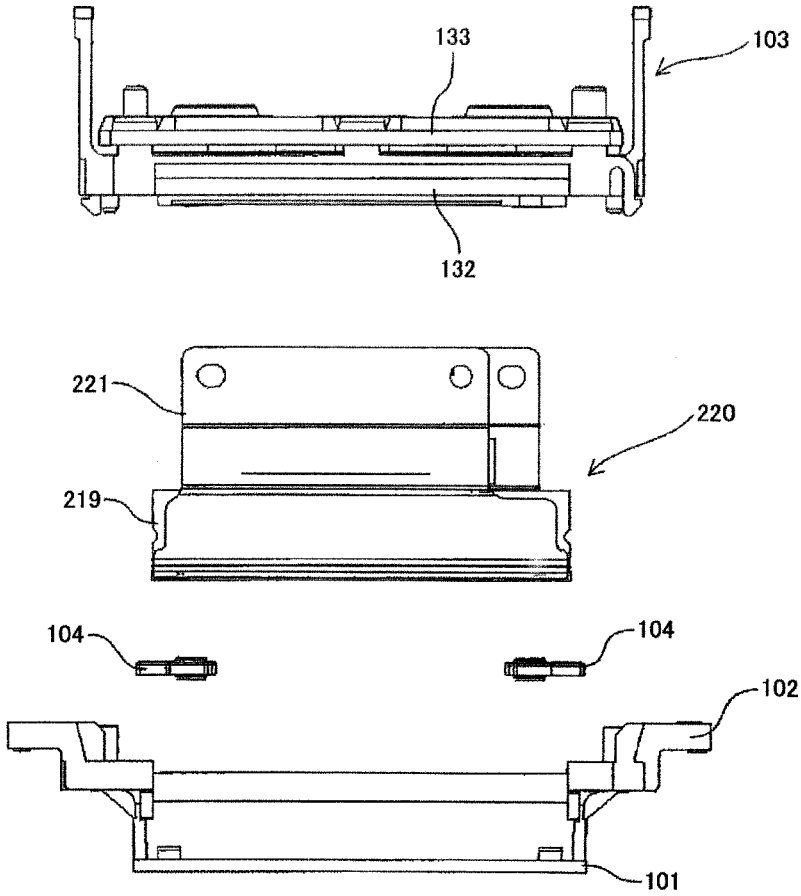
FIG. 5 is an exploded side illustration diagram of the liquid ejecting head.

Next, an entire configuration of one example of a liquid ejecting head according to an embodiment of the present invention which composes a recording head of such an image forming apparatus will be described with reference to FIG. 2 to FIG. 5. FIG. 2 is an appearance perspective illustration diagram of the same liquid ejecting head and FIG. 3 is an exploded perspective illustration diagram of the same while FIG. 4 is an exploded perspective illustration diagram on a condition that a part of components of the same is removed and FIG. 5 is an exploded side illustration diagram of the same.

Such a liquid ejecting head 100 has a liquid chamber member 101 composed of a nozzle plate and a flow channel plate as described below in detail and a vibrating plate member, and a frame member 102 which also serves as a common liquid chamber member, wherein a filter unit 103 is arranged at an upstream side of a liquid supply route of the frame member 102.

A packing member 104 is provided on an interface of a liquid supply route between the filter unit 103 and the frame member 102, wherein the packing member 104 is embedded in a dent 121 for placement of a packing member which is formed on the frame member 102 at a time of assembly, and subsequently, the filter unit 103 is placed thereon from above and fixed by a screw fastening to seal the liquid supply route.

Furthermore, the frame member 102 and the liquid chamber member 101 are fixed by an adhesive.

For the filter unit 103, a filter member 131 is provided for filtering out an impurity in a liquid (ink) supplied from a main tank. Such a filter member 131 is composed of, for example, an SUS material, and formed via a sintering process. A periphery of the filter member 131 is melted by heat and bonded to a filter case 132 composed of, for example a thermoplastic resin so as to attach the filter member 131 to the filter case 132, and subsequently, a filter case 133 is embedded therein so as to fasten the filter case 132 therewith.

Additionally, fastening of the filter case 133 and the filter case 132 is conducted by thermally caulking a protrusion for thermal caulking formed on the filter case 132 on a condition that both components are pressed and adhered tightly.

Furthermore, the filter case 133 is provided by integrally molding a thermoplastic resin as a structure and follow channel forming member and an elastomer as a packing member in a two-color molding process. Thereby, sealing of a component interface is conducted by an elastomer as a packing member at a time of fastening of the filter case 133 and the filter case 132.

Figure 6:
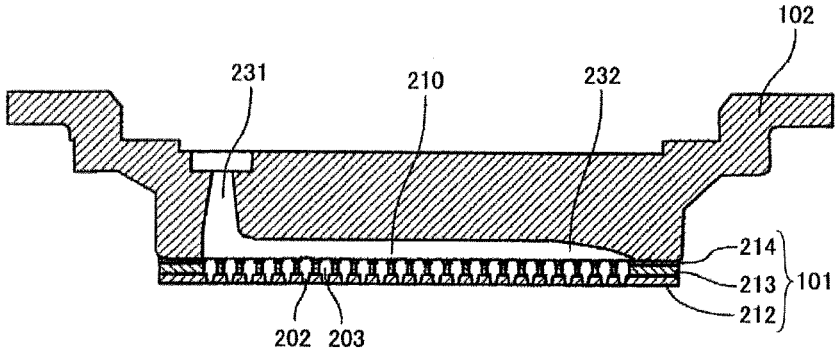
FIG. 6 is a cross-sectional illustration diagram of an essential part in a direction of nozzle arrangement for the liquid ejecting head.
Figure 7:
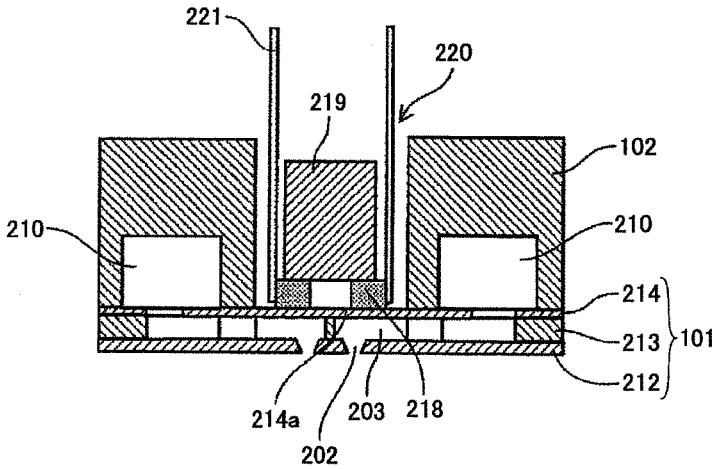
FIG. 7 is a cross-sectional illustration diagram of the essential part in a direction orthogonal to a direction of nozzle arrangement.
Figure 8:
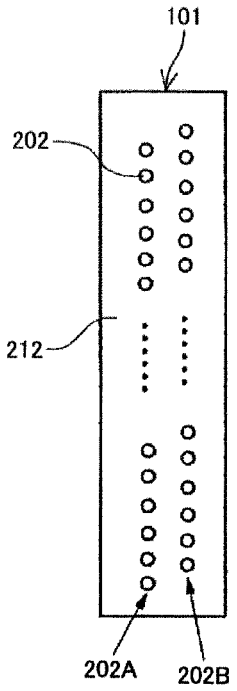
FIG. 8 is an illustration diagram of a nozzle face of the liquid ejecting head.

Next, a configuration of a flow channel of such a liquid ejecting head will be described in detail with reference to FIG. 6 to FIG. 8. FIG. 6 is a cross-sectional diagram of the liquid ejecting head in a direction of nozzle arrangement and FIG. 7 is a cross-sectional diagram of an essential part of the liquid ejecting head in a direction orthogonal to a direction of nozzle arrangement, while FIG. 8 is an illustration of a nozzle face of the liquid ejecting head. Additionally, FIG. 6 provides a cross-section along a flow channel in a direction orthogonal to a direction of nozzle arrangement.

A liquid chamber member 101 joins a nozzle plate 212, a flow channel plate 213, and a vibrating plate member 214.

For the nozzle plate 212, plural nozzles 202 for ejecting a liquid drop have two nozzle sequences 202A and 202B which are zigzag arranged in two sequences, as is also illustrated in FIG. 8. For such a nozzle plate 212, it may be possible to form a nozzle 202 by, for example, press working using a stainless steel.

The flow channel plate 213 forms a separate liquid chamber 203 communicating with the nozzle 202. Such a flow channel plate 213 is formed by, for example, anisotropic etching of silicon, but it may also be possible to use a metal material such as a stainless steel.

The vibrating plate member 214 is formed as a vibrating region 214*a* capable of deforming a part of a wall face of the separate liquid chamber 203. Such a vibrating plate member 214 is formed by electroforming of Ni.

For a frame member 102, a common liquid chamber 210 for supplying a liquid to each separate liquid chamber 203 is formed.

Furthermore, a piezoelectric actuator 220 is arranged at an opposite side of the separate liquid chamber 203 in the vibrating region 214*a* of the vibrating plate member 214. For the piezoelectric actuator 220, two piezoelectric members 218 for which pillar-shaped piezoelectric elements (piezoelectric pillars) are formed at, for example, a pitch twice as much as a nozzle pitch are joined to one base member 219 in line with two nozzle sequences. Each piezoelectric pillar of the piezoelectric members 218 is joined to the vibrating region 214*a* of the vibrating plate member 214, connected to a flexible wiring member 221 such as an FPC or FEC, and provided with a driving signal by a driving circuit (driver IC) 222 mounted on the flexible wiring member 221.

In such a liquid ejecting head, the vibrating region 214*a* of the vibrating plate member 214 is deformed by driving the piezoelectric actuator 220 so that a liquid in the separate liquid chamber 203 is pressurized to eject a liquid drop from the nozzle 202.

Figure 9:
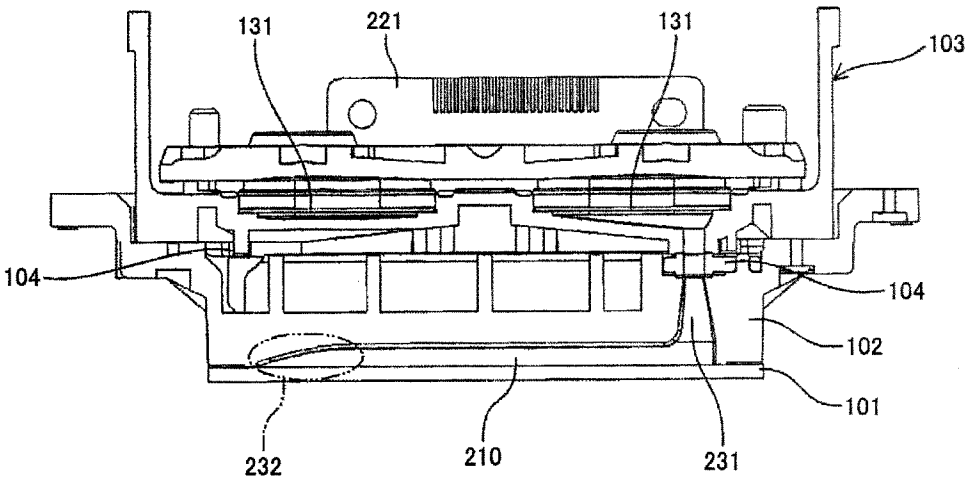
FIG. 9 is a side illustration diagram of the liquid ejecting head.
Figure 10:
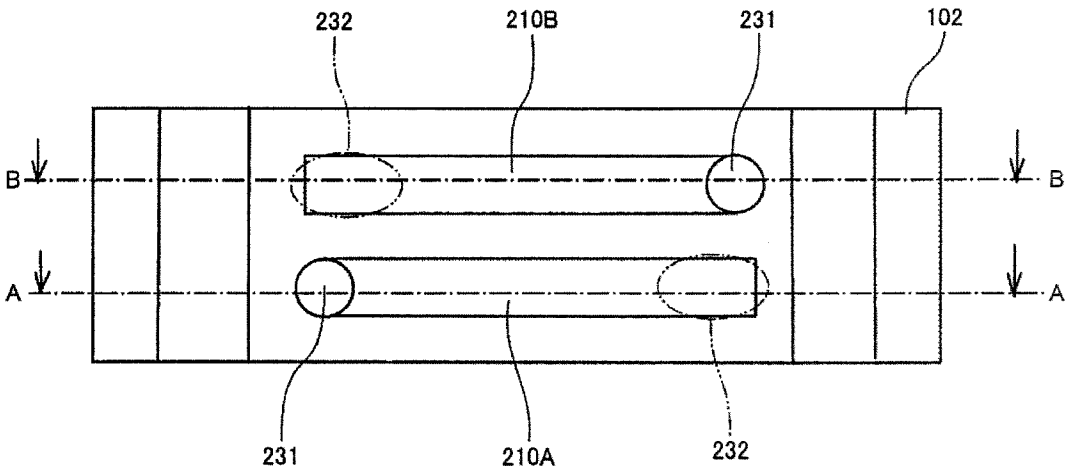
FIG. 10 is a plan illustration diagram of a frame member of the liquid ejecting head as viewed from a side of a liquid chamber member.
Figure 11:
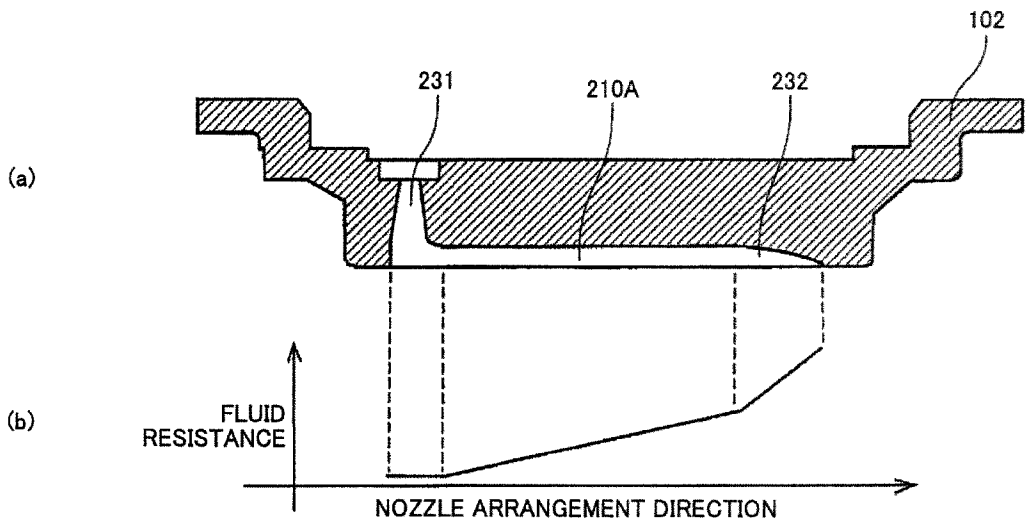
FIG. 11 is a cross-sectional illustration diagram along line A-A in FIG. 10 and an illustration diagram for illustrating a relation between a common liquid chamber and a fluid resistance.
Figure 12:
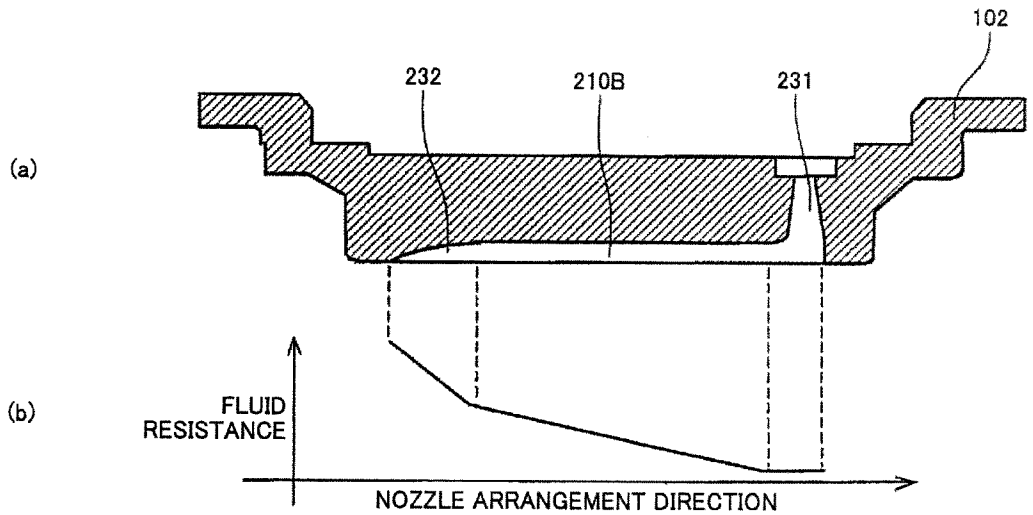
FIG. 12 is a cross-sectional illustration diagram along line B-B in FIG. 10 and an illustration diagram for illustrating a relation between a common liquid chamber and a fluid resistance.

Next, a configuration of a common liquid chamber of such a liquid ejecting head will be described with reference to FIG. 9 to FIG. 12. FIG. 9 is a side illustration diagram of the liquid ejecting head and FIG. 10 is a plan illustration diagram of a frame member of the liquid ejecting head as viewed from a side of a liquid chamber member, while FIG. 11 is a cross-sectional illustration diagram along line A-A in FIG. 10 and an illustration diagram illustrating a relation between a common liquid chamber and a fluid resistance and FIG. 12 is a cross-sectional illustration diagram along line B-B in FIG. 10 and an illustration diagram illustrating a relation between a common liquid chamber and a fluid resistance.

Such a liquid ejecting head has a common liquid chamber 210A for supplying a liquid to plural separate liquid chambers which correspond to a nozzle sequence 202A and a common liquid chamber 210B for supplying a liquid to plural separate liquid chambers 206 which correspond to a nozzle sequence 202B.

Herein, for one common liquid chamber 210A, a supply port part 231 for supplying a liquid from an exterior is formed at a side of one end portion in a direction of nozzle arrangement (at "a side of filter unit 103" in the present embodiment) and an aperture part 232 whose cross-section in a direction orthogonal to a direction of nozzle arrangement decreases toward an end portion is formed at a side of the other end portion in a direction of nozzle arrangement.

For the other common liquid chamber 210B, a supply port part 231 for supplying a liquid from an exterior is formed at a side of the other end portion in a direction of nozzle arrangement and an aperture part 232 whose cross-section in a direction orthogonal to a direction of nozzle arrangement toward an end portion is formed at a side of one end portion in a direction of nozzle arrangement.

That is, a positional relationship between the supply port part 231 and aperture part 232 of one common liquid chamber 210A which corresponds to one nozzle sequence 202A and a positional relationship between the supply port part 231 and aperture part 232 of the other common liquid chamber 210B which corresponds to the other nozzle sequence 2028 are opposite in horizontal directions of FIG. 9.

Herein, a fluid resistance of the common liquid chamber 210A from the supply port part 231 to each separate liquid chamber 203 is small at an upstream side at which the supply port part 231 is provided, increases toward a downstream side, and is highest at a downstream end of the aperture part 232, in a longitudinal direction of a common liquid chamber 210 (a direction of liquid flow in a common liquid chamber).

Hence, when one common liquid chamber 210 is seen, a fluid resistance from a supply port to the separate liquid chamber 203 may be different between an upstream side and a downstream side, so that dispersions may occur in an amount of a liquid supplied to the plural separate liquid chambers 203 and an amount of an ejected liquid, and as a result, an unevenness may occur in a formed image.

However, in the present embodiment, relationships of arrangement of the supply port parts 231 and aperture parts 232 of common liquid chambers 210A and 210B correspond to the two nozzle sequences 202A and 202B are opposite in horizontal directions of FIG. 9, and accordingly, fluid resistance changes of the two common liquid chambers 210A and 210B are in opposing relationships as illustrated in FIG. 11 and FIG. 12.

As a result, when liquid drops with an identical color are ejected from the two nozzle sequences 202A and 202B, dispersions in an amount of a supplied liquid and an amount of an ejected liquid may change in opposing relationships between the two nozzle sequences and concentrations thereof may also change in opposing relationships, whereby an unevenness in such an concentration may be canceled totally to reduce degradation of an image quality.

Furthermore, when arrangement of the two common liquid chambers 210A and 210B is provided as described above, for example, a component such as an FPC 221 arranged to be directed from an internal space 113 of a frame member 102 to an outside of a liquid ejecting head 100 may not be disturbed by a shape of the supply port part 231 so as to facilitate a layout design.

Furthermore, while two FPCS 221 are arranged oppositely, the supply port parts 231 of the common liquid chambers 210A and 210B are arranged alternately, whereby it may be possible to readily provide a common shape to each of the FPCS 221.

For example, when the FPC 221 is formed into an L-shape to avoid the supply port part 231 and if the supply port part 231 is provided at an identical side, the two FPCS 221 arranged oppositely may have an L-shape with a lack of a right side and an L-shape with a lack of a left side when an electrode side is viewed in front, and may have different shapes. However, when the supply port part 231 is provided at an opposite side, it may be possible to provide both of FPCS 221 with a common shape.

On the other hand, when the supply port parts 231 of the common liquid chambers 210A and 210B are arranged at a side of either one end portion of the head 100, it may also be possible to provide the FPC 221 with a common shape, but it may be necessary to provide the liquid ejecting head 100 with a large outline dimension and accordingly a carriage 4 and an apparatus, per se, may be provided with a large size.

Furthermore, when the head is viewed from a side orthogonal to a direction of nozzle arrangement, it may be preferable to arrange the supply port part 231 corresponding to one common liquid chamber so as to overlap with the aperture part 232 corresponding to the other common liquid chamber. As illustrated in FIG. 11, the aperture part 232 is frequently arranged at a downstream side of the common liquid chamber 210A limitedly in view of a characteristic of discharge of air bubbles in the common liquid chamber, but a fluid resistance may increase rapidly in such a region so that an image concentration may tend to be reduced rapidly at time of printing. Hence, the supply port part 231 of the other common liquid chamber is arranged to overlap with such a portion whereby it may be possible to ensure a sufficient amount of a liquid to be ejected from a nozzle at a side of the other common liquid chamber and make rapid reduction of image concentration caused by the aperture part 232 be less noticeable.

Figure 13:
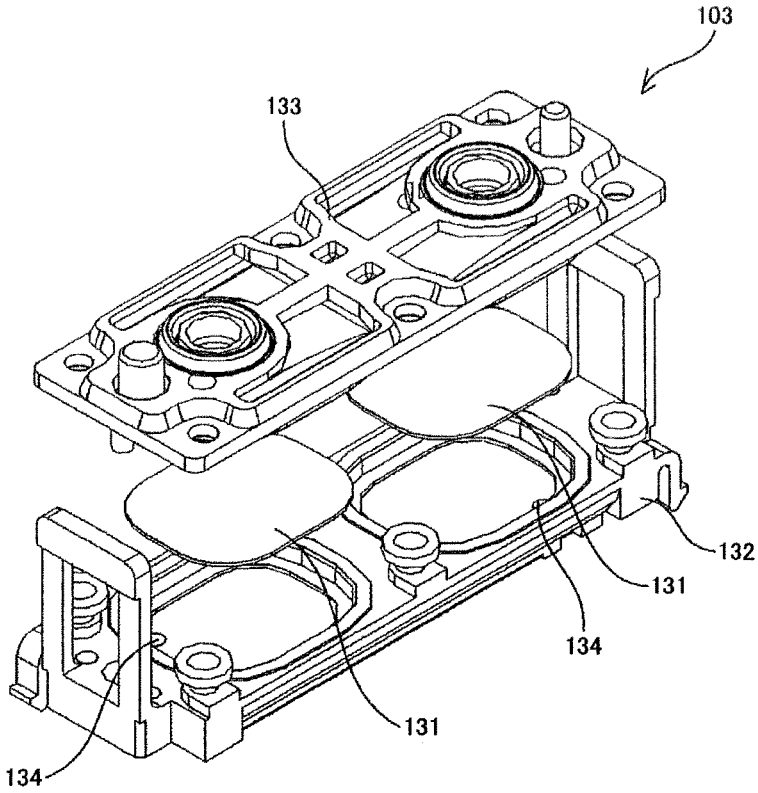
FIG. 13 is an exploded perspective illustration diagram of a filter unit.

Next, a filter unit will be described together with reference to FIG. 13. FIG. 13 is an exploded perspective illustration diagram of a filter unit.

As mentioned above, the supply port parts 231 of the two common liquid chambers 210A and 210B arranged alternately being connection parts to a filter unit 103 are provided in such a manner that cross-sections thereof at a side of the filter unit 103 are narrowed, and arranged at end portions at opposite sides in a direction of nozzle arrangement, as illustrated in FIG. 10 and FIG. 11.

Two filter members 131, which are components, are arranged in the filter unit 103. Herein, it is preferable for the filter member 131 for filtering a liquid to have as small a fluid resistance as possible at time of passage of a liquid in order to provide as small an influence as possible on a liquid drop ejection characteristic. Accordingly, it is preferable for a shape of the filter member 131 to have as large a surface area as possible and to have a generally circular shape with a small resistance.

A liquid passing through the filter member 131 flows from an outlet 134 provided on a filter case 132 through a packing member 104 into a supply port part 231.

When two supply port parts 231 are arranged alternately as the present embodiment, it may be possible to form each of the two filter members 131 near a side of a different end portion of the head, and accordingly, it may be possible to provide a shape capable of having a large surface area, having a generally circular shape with a high efficiency from the viewpoint of a fluid resistance, and providing as small influence as possible on an ejection characteristic.

Figure 14:
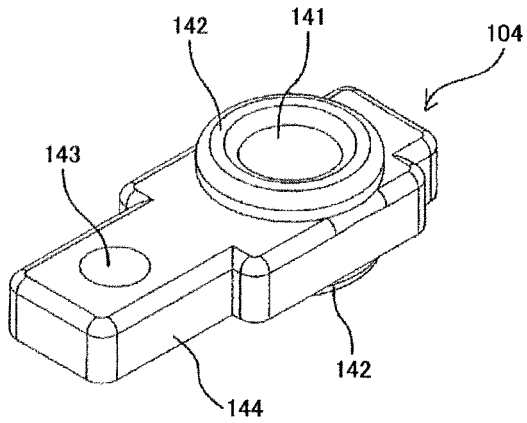
FIG. 14 is a perspective illustration diagram of a packing member of the liquid ejecting head.

Next, a packing member between a filter nit and a frame member will be described with reference to FIG. 14. FIG. 14 is a perspective illustration diagram of the same packing member.

A packing member 104 is arranged as a sealing member for a liquid supply route between a filter unit 103 and a frame member 102.

Such a packing member 104 is formed of a fluororubber in order to prevent an impurity from contaminating a liquid flowing through a flow channel 141. Furthermore, a fluororubber with a high hardness characteristic is used.

The packing member 104 is embedded in a dent 121 for placement of the packing member being formed on a frame member 102 and positioned simultaneously. Specifically, a position thereof is determined by embedding a positioning boss formed on the frame member 102 in a positioning hole 143 formed on the packing member 104 and striking a sidewall part 144 of the packing member 104 to a sidewall of the dent 121 formed on the frame member 102.

Then, after positioning of the packing member 104, the filter unit 103 is placed from above, and the packing member 104 is compressed and simultaneously fastened by a screw. A nip part 142 of the packing member 104 compressed by the filter unit 103 is elastically deformed to generate a reaction force against a counterpart whereby an interface part between respective components for forming a liquid supply route is sealed.

Herein, the packing material 104 with a high hardness is used as mentioned above. On the other hand, the filter unit 103 is formed of a thermoplastic resin with a comparatively small plate thickness.

Accordingly, differently from the present embodiment, when a supply port part 231 is arranged to juxtapose to the frame member 102, the packing member 104 is also arranged to juxtapose thereto accordingly, whereby a reaction force generating at time of compression of the packing member 104 may concentrate at one spot, and as a result, a part of the filter unit 103 may be greatly deformed. If the filter unit 103 is greatly deformed, an amount of compression of the packing member 104 may be insufficient and a sealing performance of an interface part may be degraded.

However, the supply port parts 231 are configured to be arranged alternately in the present embodiment, the packing members 104 are also alternately arranged accordingly, so that a reaction force generating at time of compression of the packing members 104 may be dispersed. Thereby, deformation of the filter unit 103 may also be dispersed so that an amount of compression of the packing members 104 may not be insufficient and it may certainly be possible to ensure a sealing performance of an interface part.

Additionally, in the present application, a material of a "paper sheet" is not limited to a paper but may include an OHP, a cloth, a glass, a base plate, etc., means one which an ink drop, another liquid, etc., is attachable to, and includes ones referred to as a medium to be recorded, a recording medium, a recording paper, a recording paper sheet, etc. Furthermore, any of image forming, recording, character printing, image printing, and printing is a synonym.

Furthermore, an "image forming apparatus" means an apparatus for conducting image formation by ejecting a liquid onto a medium such as a paper, a thread, a fiber, a cloth, a leather, a metal, a plastic, a glass, a wood, a ceramic, etc. Furthermore, "image forming" is not limited to providing a meaningful image such as a character, a graphic form, etc., to a medium but also means providing a meaningless image such as a pattern to a medium (simply landing a liquid drop onto a medium).

Furthermore, an "ink" is not limited to one referred to as an ink unless otherwise limited, but is used as a generic term of all the liquids capable of conducting image formation, such as ones referred to as a recording liquid, a fixation process liquid, a liquid, etc., and also includes, for example a DNA sample, a resist, a pattern material, a resin, etc.

Furthermore, an "image" is not limited to a planar one but also includes an image provided on one which is formed sterically, and an image formed by three-dimensionally shaping a solid, per se.

Furthermore, an image forming apparatus includes any of a serial-type image forming apparatus and a line-type image forming apparatus, unless otherwise limited.

APPENDIX

<An Illustrative Embodiment(s) of a Liquid Ejecting Head and an Image Forming Apparatus>

At least one illustrative embodiment of the present invention may relate to a liquid ejecting head and an image forming apparatus.

An object of at least one illustrative embodiment of the present invention may be to improve an image quality.

At least one illustrative embodiment of the present invention may be a liquid ejecting head according thereto, which is configured to have at least two nozzle sequences on which plural nozzles for ejecting a liquid drop are arranged, and at least two common liquid chambers which supply a liquid to plural separate liquid chambers communicated with the plural nozzles and correspond to the two nozzle sequences, wherein, for one common liquid chamber, a supply port part for supplying a liquid from an exterior is formed at a side of one end portion in a direction of nozzle arrangement and an aperture part whose cross-section in a direction orthogonal to the direction of nozzle arrangement decreases toward an end portion is formed at a side of the other end portion in the direction of nozzle arrangement, while for another common liquid chamber, a supply port part for supplying a liquid from an exterior is formed at a side of the other end portion in the direction of nozzle arrangement and an aperture part whose cross-section in a direction orthogonal to the direction of nozzle arrangement decreases toward an end portion is formed at a side of the one end portion in the direction of nozzle arrangement, in order to solve a problem as described above.

Illustrative embodiment (1) is a liquid ejecting head characterized by having at least two nozzle sequences on which plural nozzles for ejecting a liquid drop are arranged, and at least two common liquid chambers which supply a liquid to plural separate liquid chambers communicated with the plural nozzles and correspond to the two nozzle sequences, wherein, for one common liquid chamber, a supply port part for supplying a liquid from an exterior is formed at a side of one end portion in a direction of nozzle arrangement and an aperture part whose cross-section in a direction orthogonal to the direction of nozzle arrangement decreases toward an end portion is formed at a side of the other end portion in the direction of nozzle arrangement, while for another common liquid chamber, a supply port part for supplying a liquid from an exterior is formed at a side of the other end portion in the direction of nozzle arrangement and an aperture part whose cross-section in a direction orthogonal to the direction of nozzle arrangement decreases toward an end portion is formed at a side of the one end portion in the direction of nozzle arrangement.

Illustrative embodiment (2) is the liquid ejecting head as described in illustrative embodiment (1), characterized in that the aperture part of the one common liquid chamber and the supply port part of the another common liquid chamber are arranged so as to overlap when viewed from a side face orthogonal to the direction of nozzle arrangement.

Illustrative embodiment (3) is the liquid ejecting head as described in illustrative embodiment (1), characterized in that the at least two nozzle sequences eject a liquid drop with an identical color.

Illustrative embodiment (4) is an image forming apparatus characterized by including the liquid ejecting head as described in any of illustrative embodiments (1) to (3).

According to at least one illustrative embodiment of the present invention, it may be possible to average a density between two nozzle sequences and it may be possible to improve an image quality.

Although the illustrative embodiment(s) and specific example(s) of the present invention have been described with reference to the accompanying drawings, the present invention is not limited to any of the illustrative embodiment(s) and specific example(s) and the illustrative embodiment(s) and specific example(s) may be altered, modified, or combined without departing from the scope of the present invention.

The present application claims the benefit of priority based on Japanese Patent Application No. 2012-006163 filed on Jan. 16, 2012, the entire content of which is hereby incorporated by reference herein.

What is claimed is:

1. A liquid ejecting head, comprising:

at least two nozzle sequences, each nozzle sequence including plural nozzles configured to eject a liquid drop;

plural separate liquid chambers configured to communicate with the plural nozzles; and at least two common liquid chambers configured to supply a liquid to the plural separate liquid chambers and correspond to the at least two nozzle sequences, each common liquid chamber including a supply port configured to supply a liquid thereto, an aperture, a cross-section of the aperture in a direction orthogonal to a direction of arrangement of the plural nozzles decreasing toward an end portion of each common liquid chamber in the direction of arrangement of the plural nozzles, wherein the supply port of one of the at least two common liquid chambers is provided at a side of one end portion of the at least two common liquid chambers in the direction of arrangement of the plural nozzles and the aperture of the one of the at least two common liquid chambers is provided at a side of the other end portion of the at least two common liquid chambers in the direction of arrangement of the plural nozzles, and wherein the supply port of another one of the at least two common liquid chambers is provided at a side of the other end portion of the at least two common liquid chambers in the direction of arrangement of the plural nozzle and the aperture of the another one of the at least two common liquid chambers is provided at a side of the one end portion of the at least two common liquid chambers in the direction of arrangement of the plural nozzles.

2. The liquid ejecting head as claimed in claim 1, wherein the aperture of the one of the at least two common liquid chambers and the supply port of another one of the at least two common liquid chambers are arranged to overlap with each other when viewed from a direction orthogonal to the direction of arrangement of the plural nozzles.

3. An image forming apparatus, comprising:

a conveyance part configured to convey a recording medium; and a recording head configured to eject a liquid drop onto the recording medium, wherein the recording head includes the liquid ejecting head as claimed in claim 2.

4. The liquid ejecting head as claimed in claim 1, wherein the plural nozzles are configured to eject a liquid drop with an identical color.

5. An image forming apparatus, comprising:

a conveyance part configured to convey a recording medium; and a recording head configured to eject a liquid drop onto the recording medium, wherein the recording head includes the liquid ejecting head as claimed in claim 4.

6. An image forming apparatus, comprising:

a conveyance part configured to convey a recording medium; and a recording head configured to eject a liquid drop onto the recording medium, wherein the recording head includes the liquid ejecting head as claimed in claim 1.

* * * * *